United States Patent [19]

Bond

[11] Patent Number: 4,864,314

[45] Date of Patent: Sep. 5, 1989

[54] DUAL BAND ANTENNAS WITH MICROSTRIP ARRAY MOUNTED ATOP A SLOT ARRAY

[75] Inventor: Kevin J. Bond, Harlow, England

[73] Assignee: Cossor Electronics Limited, Harlow, England

[21] Appl. No.: 819,530

[22] Filed: Jan. 16, 1986

[30] Foreign Application Priority Data

Jan. 17, 1985 [GB] United Kingdom ..... 85 01225

[51] Int. Cl.[4] ..... H01Q 1/38; H01Q 21/00

[52] U.S. Cl. ..... 343/700 MS; 343/725; 343/771; 343/897

[58] Field of Search ..... 343/770, 771, 700 MS, 343/725, 729, 873, 840, 909, 897, 728

[56] References Cited

U.S. PATENT DOCUMENTS

| | | | |
|---|---|---|---|
| 3,290,688 | 12/1966 | Kraus | 343/731 |
| 3,771,158 | 11/1973 | Hatcher | 343/728 |
| 4,063,246 | 12/1977 | Greiser | 343/700 MS |
| 4,263,598 | 4/1981 | Bellee et al. | 343/700 MS |
| 4,284,991 | 8/1981 | Dupressoir | 343/771 |
| 4,376,938 | 3/1983 | Toth et al. | 343/700 MS |
| 4,403,221 | 9/1983 | Lamberg et al. | 343/700 MS |
| 4,450,449 | 5/1984 | Jewitt | 343/700 MS |

FOREIGN PATENT DOCUMENTS

| | | | |
|---|---|---|---|
| 161004 | 11/1985 | European Pat. Off. | 343/700 MS |

OTHER PUBLICATIONS

Chen et al., "A Dual Frequency Antenna with Dicrhroic Reflector and Microstrip Array Sharing a Common Aperture", IEEE AP-S Int'l Symp. Digest Antennas and Prop., New Mexico, May 24-28, 1982, vol. 1, pp. 296-299.

Lee et al., "Simple Formulas for Transmission Through Periodic Metal Grids or Plates", IEEE Trans. on Ant's. and Prop., vol. AP-30, No. 5, 9-82, pp. 904-909.

Cary, "Some Novel Techniques for Avoiding Antenna Obscurations and E.M.C. Effects", IEE Conference Publication No. 155, Conference Radar 77, Oct. 22-28, 1977, pp. 419-422.

Sureau, Reduction of Scattering Cross Section of Dielectric Cylinder by Metallic Core Loading, IEEE Trans. on Ant. and Prop., vol. AP-15, No. 5, Sep. 1987, pp. 657-662.

Marcuvita, "Waveguide Handbook", Section 5-20, vol. 10, M.I.T. Radiation Laboratory Series, pp. 285-286.

Munro et al., "Inductive Wire Matching Techniques for Dual Frequency Microwave Antennas and Radomes", 4th Int'l Conf. on EM Windows, Jun. 10-12, 1981, pp. 19-26.

Bond et al., "Dual Frequency Antenna Integration Using Invisible Grating Structures", IEE Proc., vol. 133, Pt. II, No. 2, Apr. 1986, pp. 137-142.

*Primary Examiner*—Rolf Hille
*Assistant Examiner*—Michael C. Wimer
*Attorney, Agent, or Firm*—Robert F. O'Connell

[57] ABSTRACT

A primary slotted array antenna operates at 10 GHz. In front of the primary antenna there is disposed a secondary antenna which operates at 1 GHz and is substantially transparent at 10 GHz. The secondary antenna is formed by an array of patch radiators and a transmission line feed network. The radiators and feed network are all formed by a conductive grid sandwiched between dielectric layers and designed to achieve the transparency at 10 GHz. At 1 GHz the grid appears as a continuous conductor forming one conductor of a microstrip transmission line. The other conductor (ground plane) is formed by the conductive front surface of the primary antenna. The grid/dielectric sandwich is suitably spaced from the ground plane by low dielectric pads. Other embodiments use slotline or coplanar stripline techniques. The ground plane may be an integral part of the secondary antenna, also constructed to be transparent at primary frequency.

2 Claims, 5 Drawing Sheets

DUAL BAND ANTENNAS WITH MICROSTRIP ARRAY MOUNTED ATOP A SLOT ARRAY

FIELD OF THE INVENTION

This invention relates to an antenna operational at a first nominal frequency, i.e. that frequency about which a bandwidth of operation is disposed, the antenna being so constructed that it is substantially transparent at a second nominal frequency. References below to 'radiating', 'transmitting' and so on apply equally to absorption, reception and so on since antennas are reciprocal devices.

DESCRIPTION OF THE PRIOR ART

In many applications, particularly on aircraft, integration of two or more antennas into the same physical space is desirable. Such integration is constrained by the need to keep the resultant degradation of a primary antenna, in front of which a secondary antenna is disposed, to a minimum. This may be achieved by constructing the secondary antenna from a compensated structure which is designed to be transparent at the primary frequency. 'Transparent' means that the transmission of the primary antenna must not be seriously affected by the presence of the secondary antenna within its aperture.

Two techniques for constructing transparent structures have been used. A metal conductor surrounded by a dielectric collar can be made transparent at a specific frequency. This method has been used to design dipoles disposed in the aperture of radar antennas. The second technique is to use a wire grating on or embedded in a sheet of dielectric material, thus forming a compensated structure which is a transparent sheet at the primary frequency and a conducting sheet at the secondary frequency. While it is usual for two orthogonal gratings to be used to compensate the structure for all incident polarisations, the use of a single parallel grating is not excluded. This second technique has also been applied to the construction of dipoles in the aperture of a primary antenna. Typically, the invisible dipoles are arranged in an array on the surface of a primary parabolic reflector antenna, the array operating at an octave lower frequency than the primary antenna. In this configuration the dipoles are fed through the parabolic reflector surface, thus limiting their application in cases in which rear access is possible. An example of rear access not being acceptable is in the case of a primary slot array. Furthermore, such a dipole requires a standoff distance from the surface of the reflector of approximately a quarter of a wavelength at the secondary frequency, which gives the dipole a disagreeably high profile and results in a non-robust structure.

SUMMARY OF THE INVENTION

It is an object of the present invention to provide a secondary antenna having a lower profile than that of the equivalent invisible dipole. It is a subsidary object of the invention to provide an antenna which does not have to be fed through from the back of the primary antenna and which can be constructed as a separate, self-contained unit for fitting in front of a primary antenna.

According to the present invention there is provided an antenna operative at a first nominal frequency and comprising a transmission line sandwich structure. The structure comprises a ground plane, at least one dielectric layer and a second conductive plane consisting of one or more conductive areas shaped to define an array of flat plate radiators or slot radiators dimensioned in accordance with the first nominal frequency. A feed network is provided for the radiators such that they collectively provide a directional radiation pattern at the first nominal frequency. At least the said conductive area or areas is formed of a conductive grid which appears as a continuous conductor at the first nominal frequency but is substantially transparent at a second nominal frequency.

The types of transmission line sandwich used may be either microstrip, slotline or co-planar stripline.

In the case of microstrip line each flat plate radiator is formed by one of the conductive areas. The ground plane may also be formed of a conductive grid transparent at the second frequency but it may be the reflector of a primary antenna on to which the dielectric layer(s) and conductive areas are built. The flat plate radiators may be fed through the ground plane, e.g. through the primary antenna reflector. The feed line lengths have to be adjusted to compensate for the fact that the array of radiators is not flat when mounted on a dished primary reflector as ground plane.

In the case of slotline, there is one conductive area, i.e. a conductive sheet coextensive with the ground plane, and slot radiators are formed in this sheet. In the case of coplanar stripline, the ground plane and the said second conductive plane are coincident and each radiator is formed by one of the conductive areas set in a slot in the ground plane.

In an important development of the invention applicable to all the transmission line structures, the feed network is also formed by the transmission line structure. The said conductive area(s) define not only the radiators but also the feed-lines thereto. This makes it possible, using a transparent ground plane also, to construct a self-contained secondary antenna which can be mounted on or in front of a primary antenna with no modification to the primary antenna. Mounting may be effected using brackets outside the aperture of the primary antenna.

The dielectric layer(s) perform two functions. They act in conjunction with the conductive grid to provide the transparency at the second nominal frequency. They are also part of the transmission line sandwich structure. Design must concentrate foremost on the first function and the conductive grid is preferably sandwiched between two dielectric layers of equal thickness. Transparency arises at a resonance frequency. It is not possible to achieve coincident amplitude and phase resonance frequencies but it is possible to achieve satisfactory results (little degradation of primary antenna performance), e.g. by matching the phase resonance frequency to the primary antenna frequency.

It is then necessary to achieve the correct transmission line spacing, to which end a foam or other low dielectric spacing layer may be provided as a backing layer to the dielectric layers.

In order to minimise end effect and other distortions it is desirable that the structure should be as regular as possible. The overall outline of the antenna should be a simple shape and compensation for the fact that the structure is bounded, rather than infinite, may involve extending the dielectric layer(s) beyond the edges of the area occupied by the conductive areas of the second conductive plane.

In the case of slotline and coplanar stripline all slot widths preferably equal an integral number (preferably one) of grid pitches.

BRIEF DESCRIPTION OF THE DRAWINGS

Embodiments of the invention will now be described by way of example with reference to the accompanying drawings in which.

DESCRIPTION OF THE PREFERRED EMBODIMENTS

Figure 1:
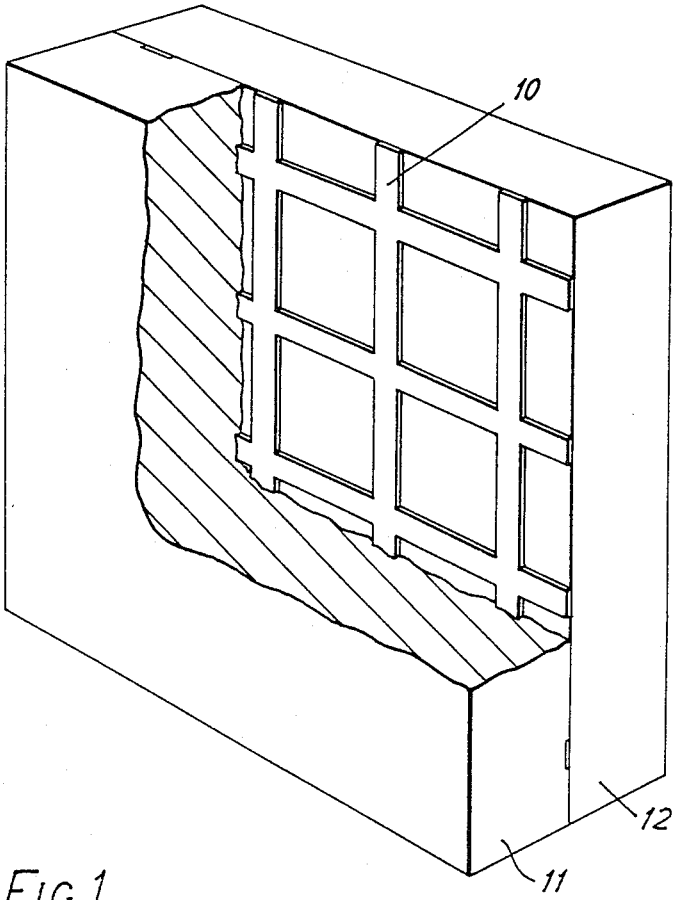
FIG. 1 is a perspective view of a compensated grating structure.

FIG. 1 shows the basic grid structure, known in itself, employed in the various embodiments of the invention. A two dimensional conductive grid 10 is sandwiched between two dielectric layers 11 and 12, which are preferably of equal thickness. Such a structure can be rendered substantially transparent at a selected frequency and the relevant design equations for a grating are to be found in Marcuvitz "Waveguide Handbook" Section 5-20 (Volume 10 in the MIT Radiation Laboratories Series). The grid 10 may be formed by printed circuit techniques on one of the layers 11 and 12, before these layers are laminated together. In practice, each dielectric layer may be a few millimeters thick. The grid pitch is not necessarily the same in the two grid directions.

Figure 2:
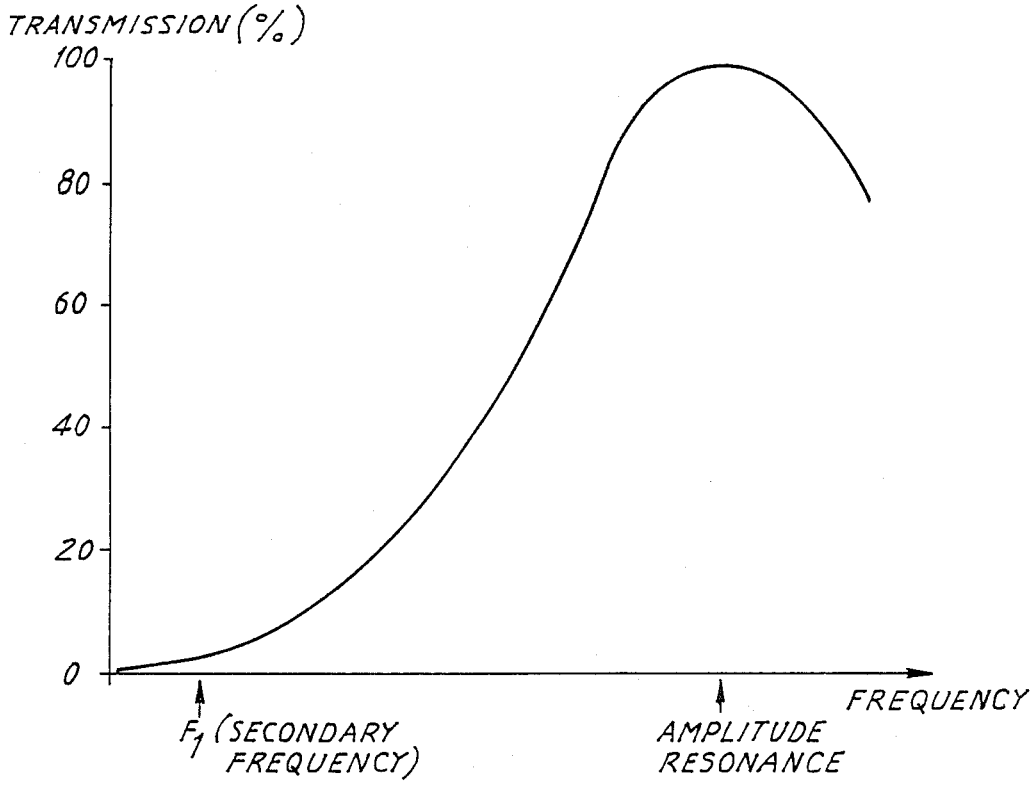
FIG. 2 is a pair of graphs showing the frequency response of the compensated grating structure of FIG. 1.
Figure 2:
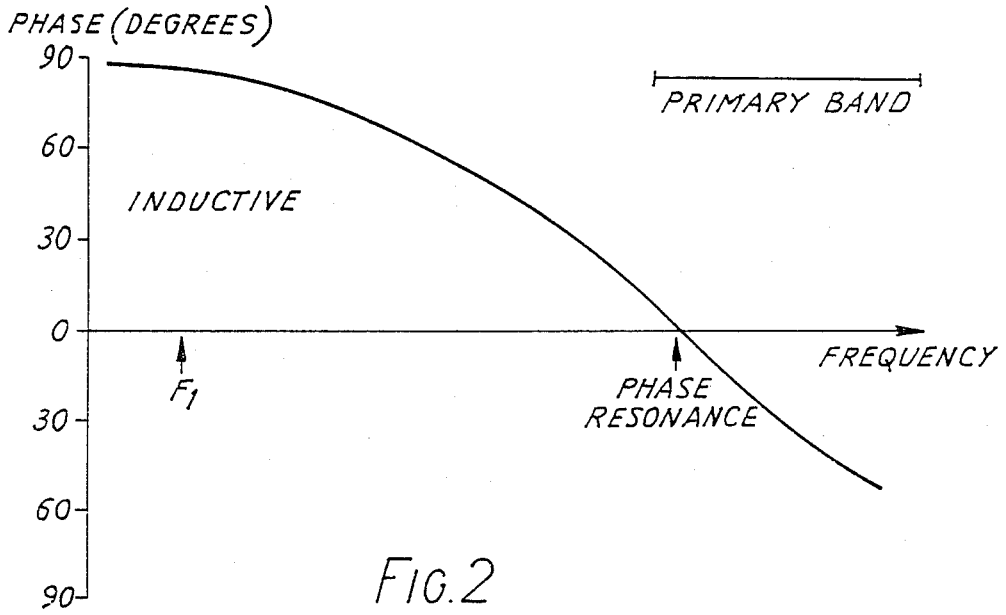

FIG. 2 shows the kind of frequency response which is obtained. The top curve shows transmissivity plotted against frequency and there is an amplitude resonance frequency at which transmission is 100%. Transmissivity falls off at lower frequencies and there is a secondary frequency $F_1$ at which the grid behaves as if it were a continuous conductive sheet. The lower diagram shows the phase response. The phase resonance frequency does not coincide with the amplitude resonance frequency but there is a primary band over which the structure may be regarded as transparent.

Best results are obtained with equal thickness dielectric layers 11 and 12 although it is possible to use layers of different thicknesses and it is even possible to dispose the grid 10 on the surface of a single layer.

Figure 3:
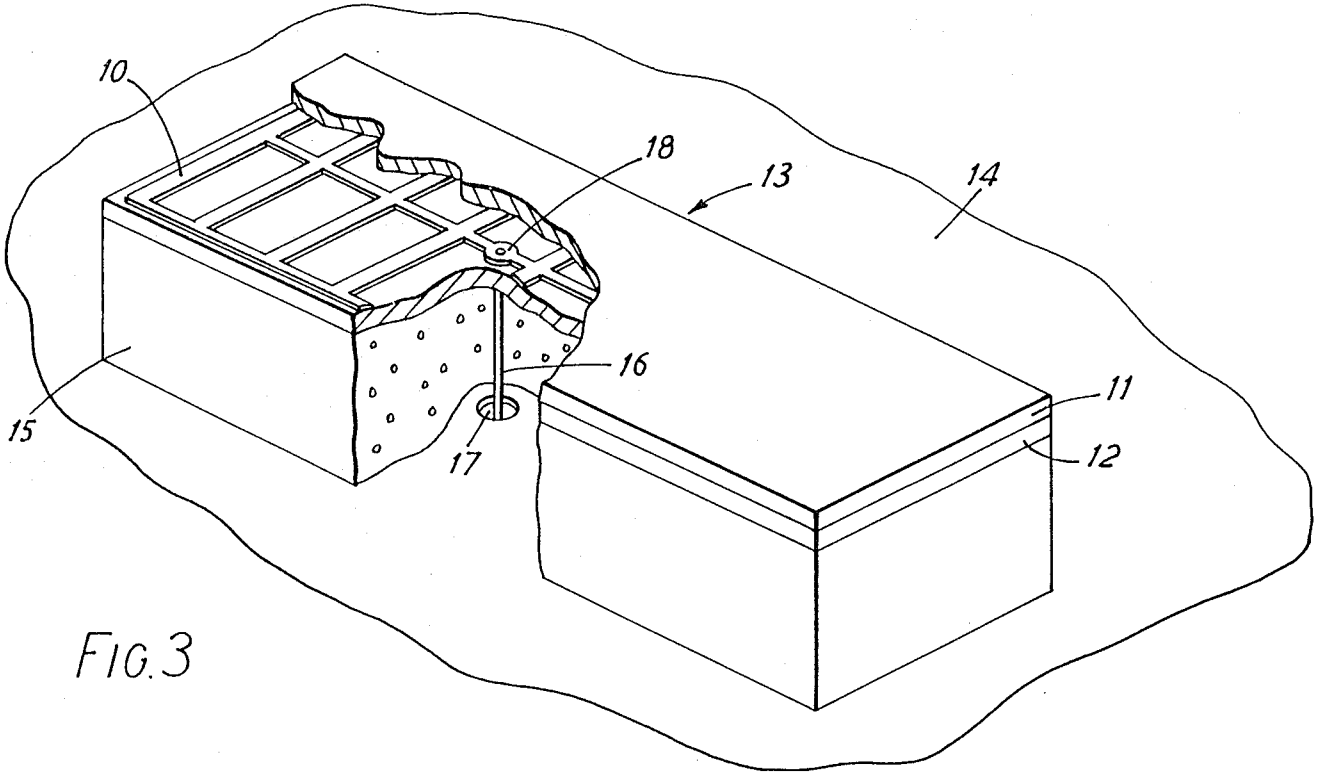
FIG. 3 is a perspective view of a microstrip radiating element of an antenna embodying the invention.

FIG. 3 shows the use of the known technique to construct a flat plate or "patch" radiator 13 on a conductive sheet 14 which may be the reflector of a primary antenna. The patch radiator is formed by a conductive grid area 10 of the kind illustrated in FIG. 1 sandwiched between its two dielectric layers 11 and 12, portions of the dielectric layers 11 and 12 extending beyond the edges of the conductive grid area 10, as shown. The conductive grid forms a small length of microstrip transmission line in conjunction with the ground plane constituted by the conductive sheet 14. The primary antenna may operate at a primary frequency of say 10 GHz. The secondary antenna may operate at 1 GHz and a suitable spacing between the conductive grid area 10 and the ground plane 14 may then be around 2 cm. Such a spacing is achieved by disposing the grid/dielectric sandwich 10, 11, 12 on a low dielectric pad 15 formed of a solid foam for example. Each patch radiator is approximately half a wavelength long at the secondary antenna frequency. In operation each patch resonates at the secondary frequency and radiates by virtue of fringe field effects.

Figure 4:
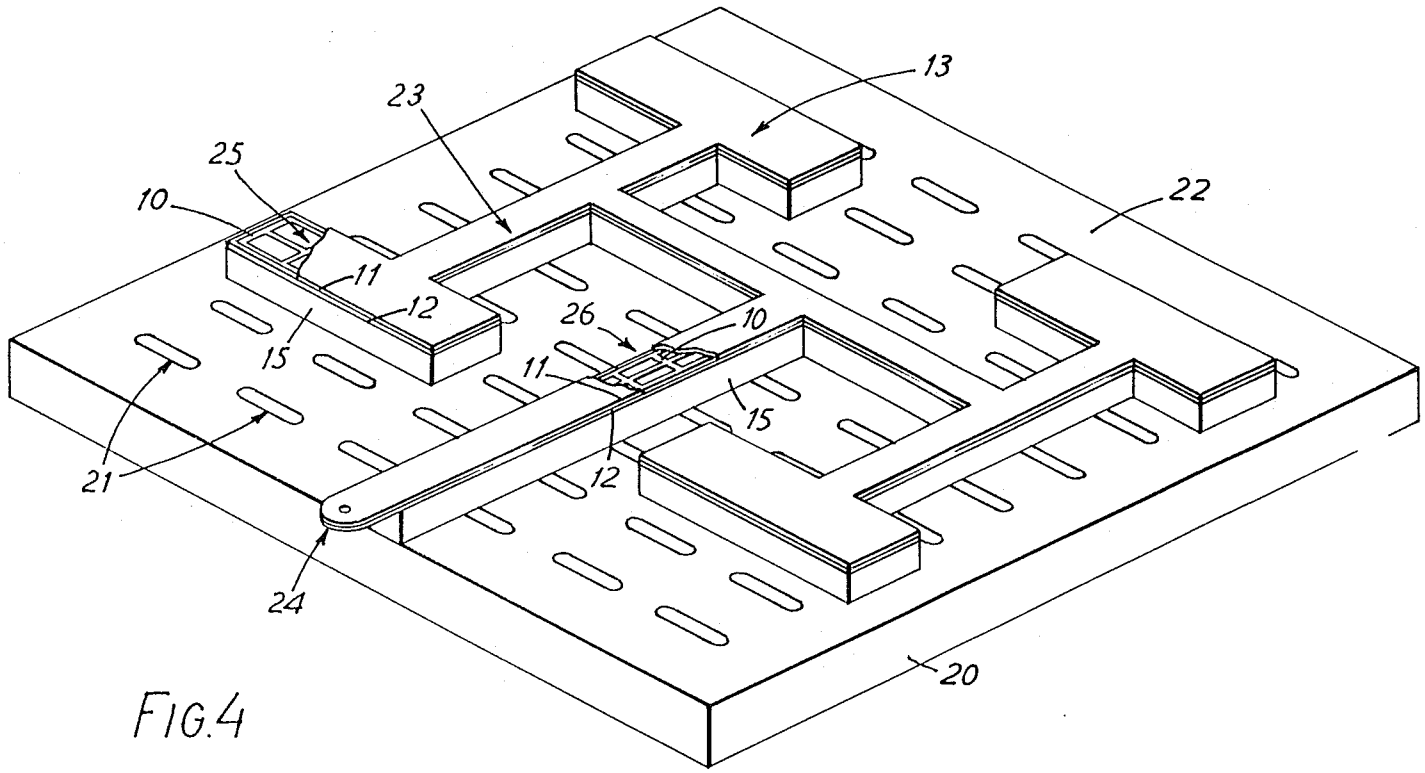
FIG. 4 is a perspective view of a second antenna embodying the invention and having a microstrip feed network as well as microstrip radiators.

Although a single patch radiator 13 is shown in FIG. 3, the secondary antenna consists of an array of such radiators, e.g. as illustrated in the embodiment of FIG. 4. The feed network for the secondary antenna comprises (in coaxial line terms) an outer conductor connected to the ground plane 14 and inner conductors 16 branching out to the patch radiators 13. Each centre conductor 16 passes through an aperture 17 in the ground plane 14 and is connected (e.g. by soldering) to a central part 18 of the conductive grid area 10. If the ground plane 14 is a dish reflector of the primary antenna, the feed network lengths to the various patch radiators 13 will have to be adjusted to compensate for the fact that the radiators are not a flat plane.

The embodiment of FIG. 3 is only suitable when the feed network can feed through from the back of the primary antenna. This is not possible if the primary antenna is a slot array for example. FIG. 4 shows a primary slot array 20 with radiating slots 21 in the front conductive sheet 22 of a waveguide transmission line structure. Built on to the front of the primary antenna is an array of patch radiators 13, each constructed as in FIG. 3. These radiators are intergral with a feed network comprising lengths of microstrip transmission line 23 extending from a centre conductor terminal 24 for the secondary antenna feeder. The conductive sheet 22 of the primary antenna is again used as the ground plane for the secondary antenna. Part of one of the path radiators 13 is broken away at 25 to illustrate the sandwich construction incorporating the conductive grid area 10, the dielectric layers 11 and 12 and the support pad 15. A portion 26 of one of the transmission line sections 23 is similarly broken away to show precisely the same construction. The feed network is thus now also on the front of the primary antenna 20. The structure as illustrated in FIG. 4 would nevertheless need to be built on to the primary antenna 20. The secondary antenna could be made a self-contained, integrated structure if it were built on to its own supporting sheet (the pads 15 could be replaced by a continuous sheet) and had its own ground plane also constructed in accordance with FIG. 1. Such a self-contained secondary antenna could then be mounted on brackets in front of the primary antenna 20.

Figure 5A:
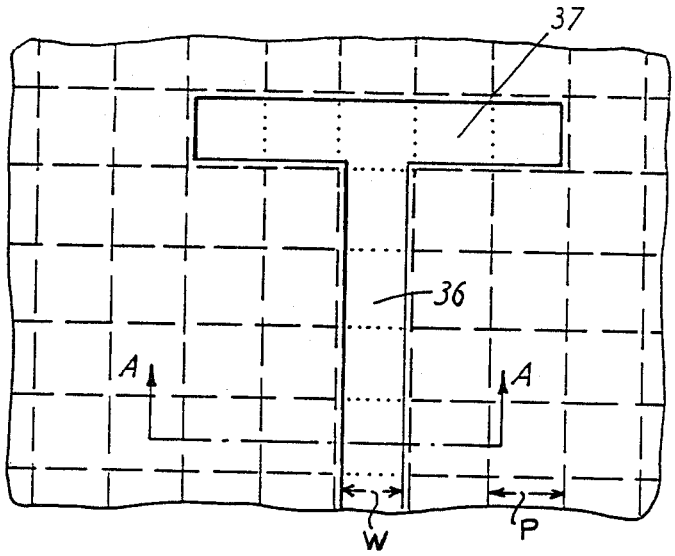
FIG. 5*a* is a plan view of a slotline radiator and feedline therefor forming part of another antenna embodying the invention.
Figure 5B:
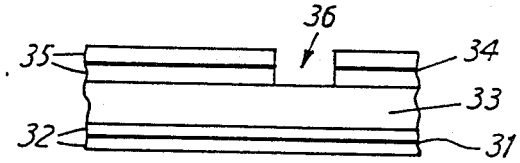
FIG. 5*b* is a sectional view on the line A—A of FIG. 5*a*.

FIGS. 5*a* and 5*b* illustrate a similar antenna of self-contained construction but based on slotline technology so that the microstrip areas of FIG. 4 become slot areas in FIGS. 5*a* and 5*b*. Referring to FIG. 5*b*, the antenna comprises a ground plane formed by a conductive grid 31 sandwiched between dielectric layers 32, a low dielectric spacing sheet 33 and a front conductive sheet formed by a second conductive grid 34 sandwiched between dielectric layers 35. The front conductive sheet is cut away to define slot feedlines 36 leading to slot radiators 37. In the plan view of FIG. 5*a*, broken lines are used to show the conductive grid 34 and it will be seen that short lengths of this grid are cut out to define the feedlines 36 and slot radiators 37, the widths w of which correspond to the grid pitch p in the respective directions. The ground plane conductive grid 31 on the other hand is not interrupted, this being indicated by the dotted lines in FIG. 5*a*.

Figure 6:
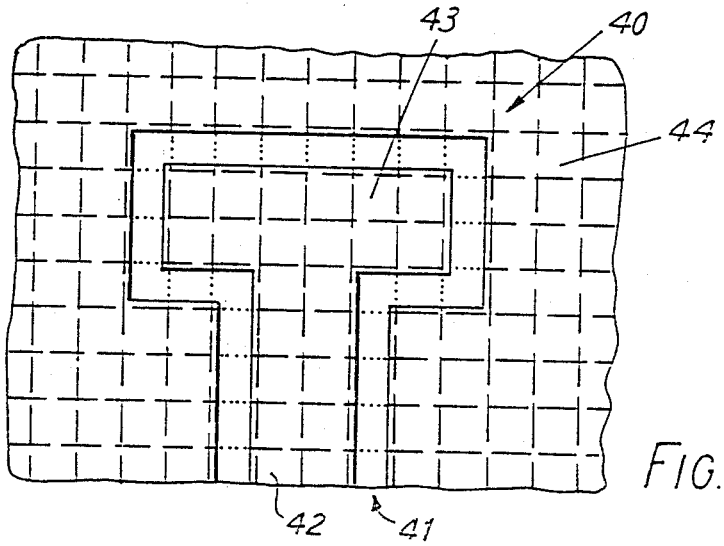
FIG. 6 is a plan view of a coplanar stripline radiator and feedline therefor forming part of another antenna embodying the invention.

Utilising similar conventions the plan view of FIG. 6 shows one radiator 40 and its feedline 41 utilising coplanar stripline techniques. At the front, there are gaps in the conductive sheet which define feedline tracks 42 and radiator patches 43 coplanar with the surrounding conductive area 44 which forms a ground plane.

I claim:

1. A dual antenna structure comprising a primary antenna operative at a first frequency and a secondary antenna operative at a second, lower frequency, said secondary antenna being formed in part by said primary antenna constituting a ground plane of said secondary antenna and further formed by a dielectric layer on said ground plane, a plurality of patch radiators on said dielectric layer supported by a foam spacer, a surrounding conductive layer also on said dielectric layer and surrounding said patch radiators, and a feed network serving said patch radiators, wherein said patch radiators and said surrounding conductive layer are formed by a conductive micro-strip grid on said dielectric layer with gaps between said patch radiators and said surrounding conductive layer, said grid being formed by mutually orthogonal first and second conductors at spacings such that said grid is substantially transparent at said first frequency but appears as a continuous conductor at said second frequency, and each gap being formed by interruptions in said first and second conductors between immediately adjacent second and first conductors respectively.

2. A dual antenna structure comprising a primary antenna operative at a first frequency and a secondary antenna operative at a second, lower frequency, said secondary antenna being formed in part by said primary antenna constituting a ground plane of said secondary antenna and further formed by a pattern of dielectric material supported by a foam spacer on said ground plane and a conductive grid pattern on said pattern of dielectric material, said conductive grid pattern being formed by conductors at spacings such that said grid pattern is substantially transparent at said first frequency but appears as a continuous conductor at said second frequency and comprising a microstrip feed network and patch radiators fed by said feed network, said pattern of dielectric material comprising strip portions underlying said feed network and patch portions underlying said patch radiators, said strip and patch portions extending beyond the edges of the feed network and patch radiators respectively.

* * * * *